US007940228B1

(12) United States Patent
Buckley

(10) Patent No.: US 7,940,228 B1
(45) Date of Patent: May 10, 2011

(54) METAMATERIAL FOR USE IN LOW PROFILE STRIPLINE FED RADIATING ELEMENTS

(75) Inventor: Michael J. Buckley, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 383 days.

(21) Appl. No.: 12/231,032

(22) Filed: Aug. 28, 2008

(51) Int. Cl.
*H01Q 21/00* (2006.01)

(52) U.S. Cl. ..... 343/810; 343/853; 343/700 MS; 343/812; 343/813; 343/893

(58) Field of Classification Search ..... None
See application file for complete search history.

(56) References Cited

U.S. PATENT DOCUMENTS

2008/0309572 A1* 12/2008 Parsche ..... 343/795
* cited by examiner

*Primary Examiner* — Trinh V Dinh
(74) *Attorney, Agent, or Firm* — Matthew J. Evans; Daniel M. Barbieri

(57) ABSTRACT

An array antenna may include a substrate, an array of metamaterial elements including radiating elements suspended in the substrate and integrated with the array of dipoles, where the metamaterial elements include a first metal layer and a second metal layer connected by a via, an array of dipoles, a groundplane coupled with a first side of the substrate, the ground plane having a symmetric slot aperture and not contacting the array of metamaterial elements, and a stripline feed for the radiating elements, where the stripline feed passes from a groundplane first side through the symmetric slot aperture to a groundplane second side.

9 Claims, 4 Drawing Sheets

METAMATERIAL FOR USE IN LOW PROFILE STRIPLINE FED RADIATING ELEMENTS

STATEMENT REGARDING FEDERALLY FUNDED RESEARCH

Part of the work performed during development of the technology was funded by government contract FA8650-04-D-4501 task order #2.

TECHNICAL FIELD

The present invention generally relates to the field of metamaterials and more particularly to a metamaterial utilized in low profile radiating elements.

BACKGROUND

An antenna may include a transducer designed to transmit or receive electromagnetic waves. Antennas may convert electromagnetic waves into electrical currents and electrical currents into electromagnetic waves. An antenna may have a physical structure including an arrangement of conductors that generate a radiating electromagnetic field in response to an applied alternating voltage and the associated alternating electric current. Additionally, an antenna may be placed in an electromagnetic field so that the field will induce an alternating current in the antenna and a voltage between its terminals. Antennas often may utilize radiating elements capable of transmitting and/or receiving electromagnetic energy.

Metamaterials may include materials designed to have magnetic or electric resonances. Generally, a metamaterial may have structural features smaller than the wavelength of the electromagnetic radiation with which it interacts. Additionally, metamaterials may include artificial materials constructed into arrays of current-conducting elements with suitable inductive and capacitive characteristics. Further, a metamaterial may have a negative refractive index.

When an electromagnetic wave interacts with a metamaterial, the metamaterial interacts with the electric and magnetic fields of the electromagnetic wave. These interactions may include altering the electromagnetic wave, such as bending or absorbing light.

SUMMARY

The present disclosure is directed to an array antenna utilizing metamaterial elements including radiating elements suspended in a substrate.

A radiating element utilizing a metamaterial configured for use in an array antenna may include a first planar layer of metal, a second planar layer of metal, where the second planar layer of metal is substantially parallel to the first planar layer of metal, a connecting metal via, where the connecting metal via is configured to be coupled to the first planar layer of metal and the second planar layer of metal, and a substrate configured to support the radiating element utilizing a metamaterial.

An array antenna may include a substrate, an array of metamaterial elements including radiating elements suspended in the substrate and integrated with the array of dipoles, where the metamaterial elements include a first metal layer and a second metal layer connected by a via, and an array of dipoles, a groundplane coupled with a first side of the substrate, the ground plane having a symmetric slot aperture and not contacting the array of metamaterial elements, and a stripline feed for the radiating elements, where the stripline feed passes from a groundplane first side through the symmetric slot aperture to a groundplane second side.

It is to be understood that both the foregoing general description and the following detailed description are exemplary and explanatory only and are not restrictive of the invention claimed. The accompanying drawings, which are incorporated in and constitute a part of the specification, illustrate an example of the invention and together with the general description, serve to explain the principles of the technology.

BRIEF DESCRIPTION OF THE DRAWINGS

The numerous objects and advantages of the present technology may be better understood by those skilled in the art by reference to the accompanying figures in which.

DETAILED DESCRIPTION

Figure 1:
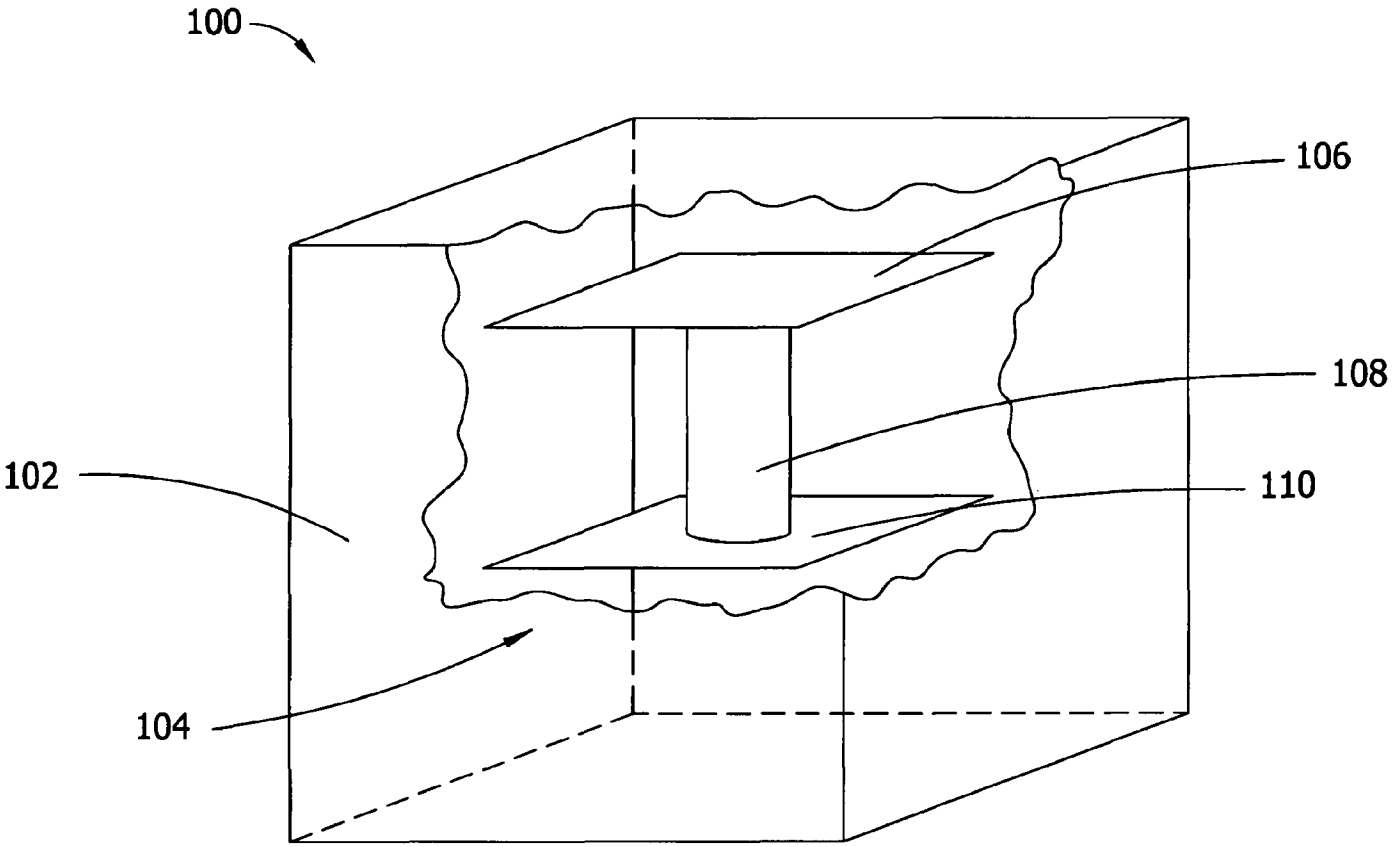
FIG. 1 is a partial isometric view illustrating a single portion of a metamaterial radiating element.

The following discussion is presented to enable a person skilled in the art to make and use the present teachings. Various modifications to the illustrated examples will be readily apparent to those skilled in the art, and the generic principles herein may be applied to other examples and applications without departing from the present teachings. Thus, the present teachings are not intended to be limited to examples shown, but are to be accorded the widest scope consistent with the principles and features disclosed herein. The following detailed description is to be read with reference to the figures, in which like elements in different figures have like reference numerals. The figures, which are not necessarily to scale, depict selected examples and are not intended to limit the scope of the present teachings. Skilled artisans will recognize the examples provided herein have many useful alternatives and fall within the scope of the present teachings.

Reference will now be made, in detail, to embodiments of the invention. Additional details of the invention are provided in the examples illustrated in the accompanying drawings.

Referring generally to FIG. 1, one depiction of a metamaterial radiating element suspended in a substrate 100 is illustrated. The metamaterial radiating element 104 may include a top metal layer 106, a bottom metal layer 110, and a connecting metal via 108.

A metamaterial may include an electromagnetically continuous structure comprising subwavelength molecules with tailorable permittivity and permeability. Permittivity may include how an electric field is affects and is affected by a dielectric medium. Permeability may be determined by the ability of a material to polarize in response to the electric field, and thereby reduce the total electric field inside the material.

A metamaterial radiating element 104 may have a dimension less than or equal to one signal wavelength. In one embodiment, a metamaterial radiating element 104 may have a dimension half of one signal wavelength.

A metamaterial radiating element 104 may include a top metal layer 106, a bottom metal layer 110, and a connecting metal via 108. The top metal layer 106 and bottom metal layer 110 may be substantially planar and may be substantially parallel to each other. Additionally, the top metal layer 106 and bottom metal layer 110 may be connected by a connecting metal via 108. The connecting metal via 108 may be in the form of a cylinder, a rectangle, or another appropriate form and/or shape. The top metal layer 106, the bottom metal layer 110, and the connecting metal via 108 may include any suitable metal and/or conductive material, such as aluminum or copper. In one embodiment, as illustrated in FIG. 1, the connecting metal via 108 may be in the form of an aluminum cylinder. The metamaterial radiating element suspended in a substrate 100 must be configured to not connect to a ground plane 602. Further, the metamaterial radiating element 104 may be scalable in frequency.

A substrate 102 may include a nonconducting substance, dielectric, and/or insulator. A substrate 102 may include a dielectric material, such as a micro dispersed ceramic PTFE composite utilizing a woven fiberglass reinforcement. One example of a suitable substrate 102 may include an Arlon CLTE laminate, available from Arlon Inc., Santa Ana, Calif. Additionally, the substrate may meet certain quality standards, such as a MIL-STD-810E standard. The MIL-STD-810 series of standards are issued by the United States Army's Developmental Test Command for specifying various environmental tests. In one example, substrate 102 may meet a MIL-STD-810E Method 509.3 standard for salt fog corrosion resistance.

Figure 3:
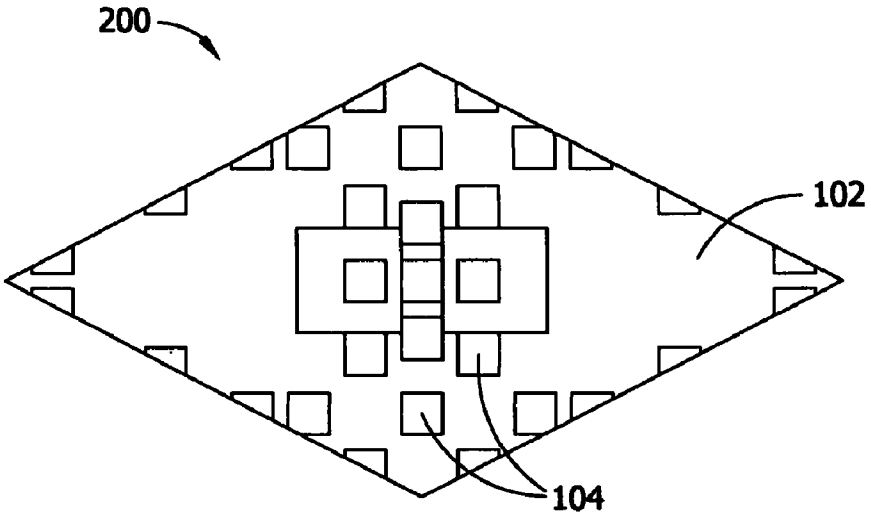
FIG. 3 is a top plan view of the array of metamaterial radiating elements suspended in a substrate illustrated in FIG. 2.
Figure 2:
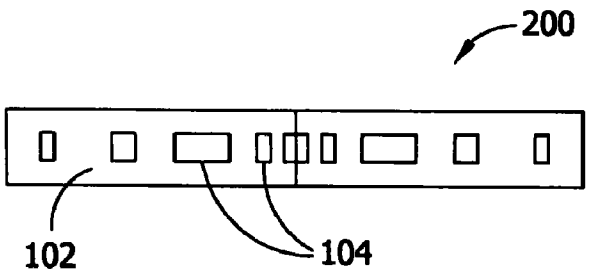
FIG. 2 is a cross-sectional view illustrating an array of metamaterial radiating elements suspended in a substrate.

Referring generally to FIGS. 2 and 3, a metamaterial radiating element array 200 is illustrated. A metamaterial radiating element array 200 may include a plurality of metamaterial radiating elements 104 suspended in a substrate 102. The plurality of metamaterial radiating elements 104 and/or dipole array 502 may be arranged in a non-uniform and/or an inhomogeneous arrangement. One example of a non-uniform arrangement may include a first metamaterial radiating element 104 located a certain distance from a second metamaterial radiating element 104 and located a different distance from a third metamaterial radiating element 104. This non-uniform arrangement may apply to each and/or only a portion of metamaterial radiating elements 104 in a metamaterial radiating element array 200. Further, each metamaterial radiating element 104 in the metamaterial radiating element array 200 may be surrounded only by the substrate 102 and may not contact the ground plane 602. In some instances, a metamaterial radiating element array 200 may include multiple layers of metamaterial radiating elements 104 and/or substrate 102. In one embodiment, a metamaterial radiating element array 200 may include three layers of substrate 102 having a non-uniformly distributed metamaterial radiating element array 200 and dipole array 502.

Figure 4:
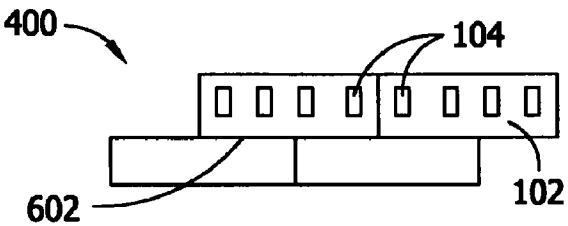
FIG. 4 is a partial cross-sectional view illustrating a metamaterial wide scan/wide band exemplary array antenna.

Referring generally to FIG. 4, a cross-sectional view of one embodiment of a wide scan/wide band metamaterial radiating element array 400 is illustrated. A wide scan/wide band metamaterial radiating element array 400 may include at least one layer including a metamaterial radiating element array 200 disposed in a substrate. Additionally, a wide scan/wide band metamaterial radiating element array 400 may include a ground plane 602. A ground plane may include a structure, such as a flat piece of metal, located between an antenna and another object. A ground plane may be designed to limit the downward radiation of an antenna and may include a flat, curved, and/or other functionally-shaped conducting material. In one embodiment, a wide scan/wide band metamaterial radiating element array 400 may include a nonuniformly distributed array of metamaterial radiating elements suspended in a substrate and a planar groundplane. Additionally, a wide scan/wide band metamaterial radiating element array 400 may include more than one ground plane 602.

Figure 5:
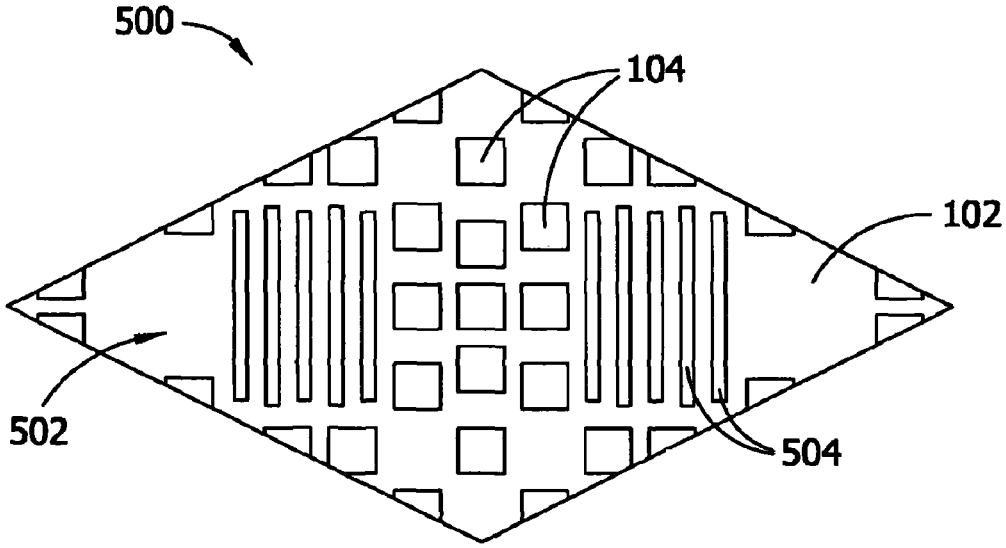
FIG. 5 is a partial top plan view illustrating an array of metamaterial radiating elements and dipoles suspended in a substrate.

As discussed above, a metamaterial radiating element array 200 may include multiple layers of metamaterial radiating elements 104 and/or substrate 102. One example of a wide scan/wide band metamaterial radiating element array top layer 500 is shown in FIG. 5. In this example, a metamaterial radiating element array 200 is shown with a plurality of nonuniformly distributed metamaterial radiating elements 104 and a plurality of strip dipole elements 504 arranged in a dipole array 502 within a substrate 102. The metamaterial radiating elements 104 may be integrated with strip dipole elements 504. A dipole array 502 may include a plurality of strip dipole elements 504 and may be symmetrical. The metamaterial radiating element array 200 and/or the dipole array 502 may be distributed nonuniformly within each radiating element. Further, the wide scan/wide band metamaterial radiating element array top layer 500 may include multiple dipole arrays 502.

Figure 6:
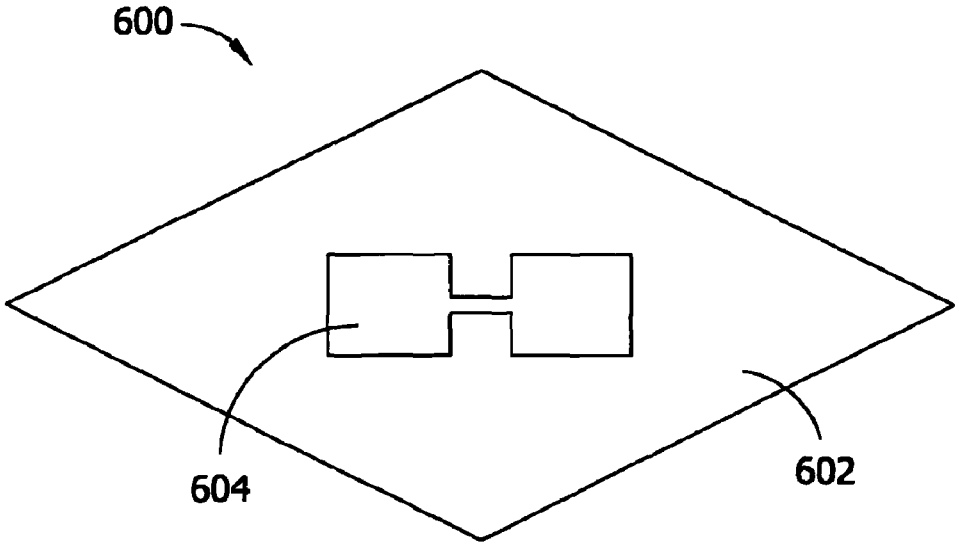
FIG. 6 is a partial top plan view illustrating a ground plane having a symmetrical slot aperture.
Figure 7:
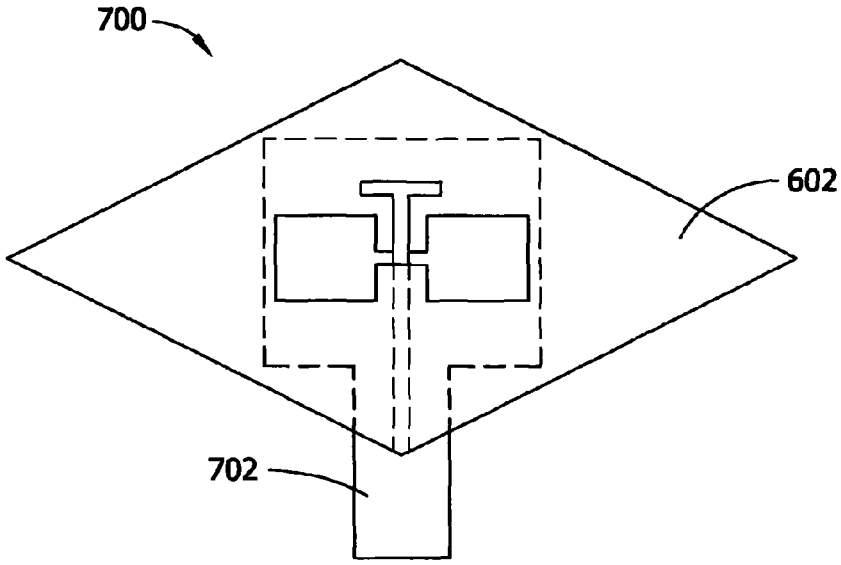
FIG. 7 is a partial top plan view illustrating a ground plane having a stripline feed and a symmetrical slot aperture.

Referring generally to FIGS. 6 and 7, a ground plane layer 600 is illustrated. A ground plane layer 600 may include a ground plane 602 having a slot aperture 604. The slot aperture 604 may be symmetric. In conjunction with a symmetric dipole array 502 and metamaterial radiating element array 200, the cross polar radiation is zero at array normal and in the E plane scan. In FIG. 7, a stripline feed layer 700 is shown with a stripline feed 702 and a ground plane layer 600. A stripline feed 702 may include a strip of metal functioning as transmission media for a stripline fed radiating element. A stripline feed 702 may be placed by etching circuitry on a substrate. In one embodiment, a stripline feed 702 may include an impedance of about 80 ohms for packaging ease. Utilizing a stripline feed 702 may be advantageous for reducing and/or eliminating electromagnetic radiation and back radiation. Further, no tuning features may be required by using the current arrangement of the metamaterial radiating element array 200, the dipole array 502, and the slot aperture 604.

Figure 8:
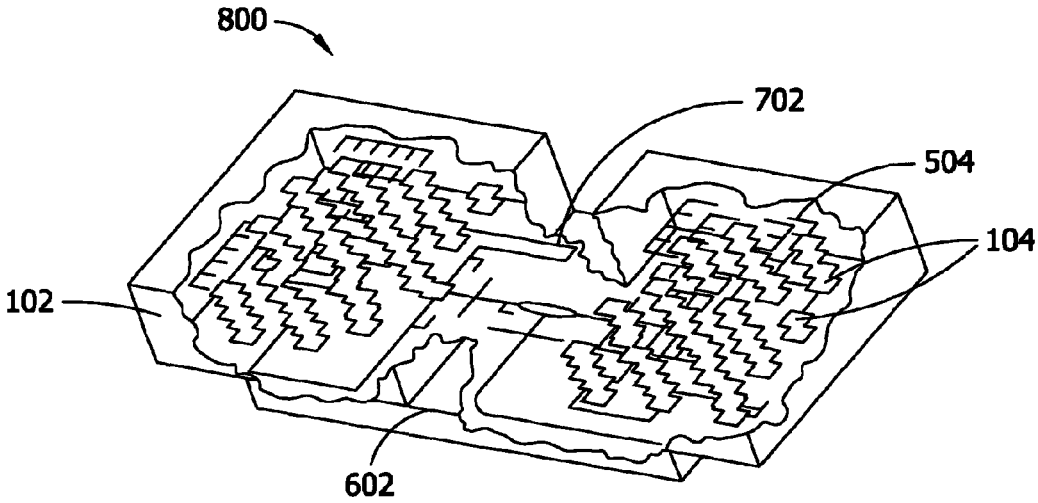
FIG. 8 is a partial isometric view illustrating an embodiment of an array antenna radiating element.

Referring generally to FIG. 8, an example of an array antenna radiating element 800 includes a metamaterial radiating element array 200, a dipole array 502, and a ground plane 602. The array antenna radiating element 800 may implement a low profile, small footprint. Additionally, the array antenna radiating element 800 may be manufactured utilizing standard printed circuit board techniques, such as etching, lamination, and lithography. In one embodiment, an array antenna radiating element 800 may include a dipole array 502 with a packed folded dipole layer. In the embodiment shown in FIG. 8, the metamaterial radiating element array 200 is shown with the substrate 102 divided into two sections for minimizing surface wave problems.

It is believed that the present technology and many of its attendant advantages will be understood from the foregoing description, and it will be apparent that various changes may be made in the form, construction, and arrangement of the components thereof without sacrificing all of its material advantages. The form herein before described being merely explanatory embodiments thereof, it is the intention of the following claims to encompass and include such changes.

What is claimed is:

1. An array antenna, comprising:

a substrate;

an array of dipoles;

an array of metamaterial elements including radiating elements suspended in the substrate and integrated with the array of dipoles, where the metamaterial elements include a first metal layer and a second metal layer connected by a via, and a groundplane coupled with a first side of the substrate, the groundplane having a symmetric slot aperture and not contacting the array of metamaterial elements; and a stripline feed for the radiating elements, where the stripline feed passes from a groundplane first side through the symmetric slot aperture to a groundplane second side.

2. The array antenna in claim 1, comprising:

a micro dispersed ceramic poly(tetrafluoroethene) composite substrate utilizing a woven fiberglass reinforcement.

3. The array antenna in claim 1, wherein the radiating elements have a dimension at least one of less than or equal to one wavelength.

4. The array antenna in claim 1, comprising:

a radiating element utilizing a metamaterial having at least one of one, two, or three substrate layers.

5. The array antenna in claim 1, comprising:

a radiating element that is scalable in frequency.

6. The array antenna in claim 1, wherein the stripline feed has an impedance of about 80 ohms.

7. The array antenna in claim 1, wherein the array of dipoles include strip dipoles.

8. The array antenna in claim 1, wherein said array of dipoles includes a packed folded dipole layer.

9. The array antenna in claim 1, further comprising: a second groundplane.

* * * * *